United States Patent [19]

Berthet et al.

[11] 4,080,920

[45] Mar. 28, 1978

[54] TOWING APPARATUS

[75] Inventors: Jean-Pierre Berthet; Jean-Guy Cailloux; Philippe Clement, all of Six Fours les Places, France

[73] Assignee: Etat Francais represente par le Delegue Ministeriel pour l'Armement, France

[21] Appl. No.: 728,898

[22] Filed: Oct. 4, 1976

[30] Foreign Application Priority Data

Nov. 6, 1975 France ..... 75 33896

[51] Int. Cl.[2] ..... B63B 21/16

[52] U.S. Cl. ..... 114/244; 114/254

[58] Field of Search ..... 114/242, 244, 245, 253, 114/254, 258, 259, 210, 16 R, 264; 254/173 R, 187.2

[56] References Cited

U.S. PATENT DOCUMENTS

| | | | |
|---|---|---|---|
| 1,694,108 | 12/1928 | Stein | 114/16 R |
| 3,577,951 | 5/1971 | Smith | 114/210 |
| 3,596,070 | 7/1971 | McCool et al. | 114/254 X |
| 3,604,387 | 9/1971 | Hale et al. | 114/254 X |
| 3,653,636 | 4/1972 | Burrell | 254/173 R |
| 3,965,842 | 6/1976 | Cailloux | 114/244 |

FOREIGN PATENT DOCUMENTS

| | | | |
|---|---|---|---|
| 1,231,486 | 5/1971 | United Kingdom | 114/244 |

*Primary Examiner*—Trygve M. Blix
*Assistant Examiner*—Sherman D. Basinger
*Attorney, Agent, or Firm*—Stevens, Davis, Miller & Mosher

[57] ABSTRACT

This invention deals with under water towing from a ship having a central well, the side walls of which are provided with arcuate slideways on which a carriage may run. This carriage has a yoke from which it supports a first pulley over which the tow cable is passed in its run between the thing towed and a second pulley located inside the ship. The yoke is pivoted to the carriage on the same axis as that of the cable run between the first and second pulleys so that the first pulley position is maintained against ship's roll. The carriage moves on the slideways so that the cable run between the two pulleys stays of equal length as the swell of the sea lifts or lowers the ship relative to the thing towed. The whole carriage — first pulley assembly can be drawn into a well-head frame which can be tilted to free the well-head from obstruction.

10 Claims, 2 Drawing Figures

TOWING APPARATUS

The present invention relates to devices for hauling an immersed body through a ship's well.

The technical sector of the invention is that concerned with the equipment of ships for hauling (or towing) immersed bodies.

It is known that immersed bodies, hauled (or towed) by a ship or boat through intermediary of a traction cable are utilized in numerous applications.

Such bodies are utilized for transporting for example sonar equipment designed to explore the sea bottom or to detect the presence of immersed objects, or apparatus for geophysical measurement or apparatus for collecting water at depth or for measurement of the properties of the latter, such as temperature, salinity, etc.

The development of petroleum research at sea and of oceanographic research has resulted in increasing utilization of such hauled or towed bodies.

At the present day, the immersed bodies are towed from the rear or the sides of the ship.

Ships are known which are equipped with a central well (or shaft) designed to lower into the sea a charge suspended from a cable, for example, a divers turret or equipment for drilling at sea, but hitherto such wells have not been employed for hauling ("towing") an immersed body.

It is one of the objects of the present invention to permit the hauling of an immersed body by a cable extending through a vertical well located in the "tranquil" center portion of a ship so as to achieve freedom from the effects of pitching and rolling movements of the ship, to facilitate introduction into the water, hoisting and storage of the immersed body, which may be interposed within the said well during displacement of the ship.

It is a further object of the present invention to suppress during haulage the excess tension in the traction cable due to the movements of the ship under the effect of swell.

These objects are achieved by means of a device comprising a first pulley over which passes the traction cable, mounted on a mobile carriage compelled to follow a travel path determined by slideways fixed on the lateral walls of the well through which the haulage is effected. The said slideways may be rectilinear.

It is a further object of the invention to prevent the said pulley from, during haulage, pivoting constantly about its axis in consequence of the swell movements, since this would involve extremely rapid wear of the traction cable which is a large cable extremely costly to replace.

The device comprises a second fixed pulley, and this object is attained due to the provision of slideways having the shape of arcs of a circle centered on the axis of the said second pulley, or in the form of an involute portion of the said second pulley.

The carriage carrying the said first pulley is suspended from at least one cable wound on an hydraulic winch.

The said cable and the said winch fulfill various functions. The winch may be utilized as motor means for lifting the carriage and the immersed body simultaneously when it is desired to interpose the said body within the well. The winch may also be utilized as "passive" damping means, by connecting the hydraulic circuit which feeds it to chambers filled with compressed air and acting as resilient buffer means.

The winch may also function as motor means dynamically subjected to the action of the vertical accelerations of the ship and of the relative displacements of the said first pulley relative to the ship. In this case, the said accelerations and the said displacements are measured and there is automatic action on the winch in a direction such that the said first pulley occupies in space an absolute position which is substantially fixed despite the movements of the ship.

A device according to the invention comprises, furthermore, a well-head frame extending above the well and supporting the pulleys of the cables for suspension of the mobile carriage, wherein the mobile carriage occupies a position in upper abutment during the operations for the hoisting the said immersed body out of the well. The said well-head frame (or derrick) is articulated about a horizontal pivot which is aligned with the axis of the said first pulley for the traction cable when the said mobile carriage is in upper abutment.

This device makes it possible to rock the said well-head frame and the mobile carriage to clear the upper aperture of the well in order that it may then be possible to grasp the immersed body by means of a lifting device.

Due to the fact that the pivoting axis of the well-head frame is merged with the axis of the second pulley, the latter remains fixed during the rocking of the well-head frame, as does also the immersed body.

Each slideway comprises two lateral flanks and the carriage is mounted on wheels equipped with pneumatic tires which roll on the said flanks.

The framework of the carriage is constituted preferably by a beam extending through the well and carrying wheels equipped with pneumatic tires, which roll on the two lateral walls of the well carrying the said slideways.

Thus, the carriage is guided in accordance with two orthogonal directions. Guiding by wheels equipped with penumatic tires has the advantage that it compensates for irregularities in the lateral flanks of the slideways and of the lateral walls of the well, in such manner that these surfaces do not require to be trued up or machined.

The movement pulley is carried by a yoke of fork shape articulated, relative to the carriage about a pivot which is substantially identical with the direction of the section of the cable connecting the said pulley to the second fixed pulley. Thus, the mobile pulley is able to orientate itself freely so as to remain in the plane determined by the two strands of the traction cable passing over the said pulley despite roll of the ship.

A device according to the invention comprises, furthermore, and preferably, two gates or doors articulated about two pivots disposed along the front edge and the rear edge of the lower aperture of the well.

The width of the said gates is substantially equal to a third of the distance between the front and rear edges of the aperture, and they may be retracted within the well. The said gates permit achievement of a substantial reduction of the drag due to the low opening of the well.

During haulage (or "towing"), only the front gate is hinged-down. In the transit position, the two gates are hinged-down.

A haulage device according to the invention may comprise, furthermore, within the well, a retractable cradle designed to support the said immersed body and to interpose it within the well.

The result of the invention is a novel device for the haulage of an immersed body hauled at the end of a cable extending through a well.

The advantages of the said device are the following:

The well is situated, preferably, at the "tranquil" point of the ship, i.e., at the point about which the ship oscillates on pitching or rolling. The result is that the effects of pitching or rolling of the ship on the cable and the excess tensions on the cable are reduced relative to what would occur if towing were to take place from the stern of the ship. Only the effects of pounding persist.

The measures effected have shown that the maximum accelerations of the pulley for motion of the traction cable, which attain 0.8 *g* in the case of stern towing, are reduced to 0.2 *g* in the case of haulage in a well, *g* being the acceleration of the weight.

The device for haulage in a well according to the invention has furthermore the advantage that it permits interpositioning of the immersed body in the well during the displacements in transit of the ship, thereby imparting a high degree of protection to the said body which is able to carry electronic circuits and fragile measurement devices.

The device according to the invention facilitates the operations of lifting the immersed body and putting it into the water. It makes it unnecessary to manipulate a load overhung. Furthermore, the surface of the water in the well is calmer than that which surrounds the ship.

It is also more readily possible to install at the base of the well a device for braking and guiding the load, comprising deformable straps or bands, which constitutes the subject of a separate patent application.

The device according to the invention makes it possible for the traction cable motion pulley to occupy an absolute position which is substantially constant despite the pounding movement of the ship, the effect thereof being to suppress the dangerous excess tensions in the traction cable.

Devices are already known for the resilient suspension of a pulley for handling loads disposed on a floating support.

These devices — known as anti-pounding slide-devices, comprise a carriage maintained by an inclined oleopneumatic jack. They make it possible to maintain the tension of the hoisting cables at a substantially constant level.

The haulage device according to the invention enables achievement of the same result with different means. It also makes it possible, utilizing slideways having the shape of an arc of a circle or a circle involute, to obtain a further extremely important result, being an absolute position of the motion pulley which is substantially constant, with absence of rotation movement of the said pulley about its axis, thereby considerably reducing wear of the towing or haulage cable. The only cable fatigue is that resulting from the movement of flexion of the section of cable connecting the pulley, which is mobile relative to the ship. The presence of a central well increases the drag of the ship, but the rocking gates or doors blocking the lower aperture of the well makes it possible to reduce this disadvantage.

The following description refers to the accompanying drawings which show an embodiment of the invention, by way of example, and without limitative character. In the drawings:

FIG. 1 shows a towing or haulage ship 1 comprising a well 2 located substantially at the "tranquil" point of the ship.

Figure 1:
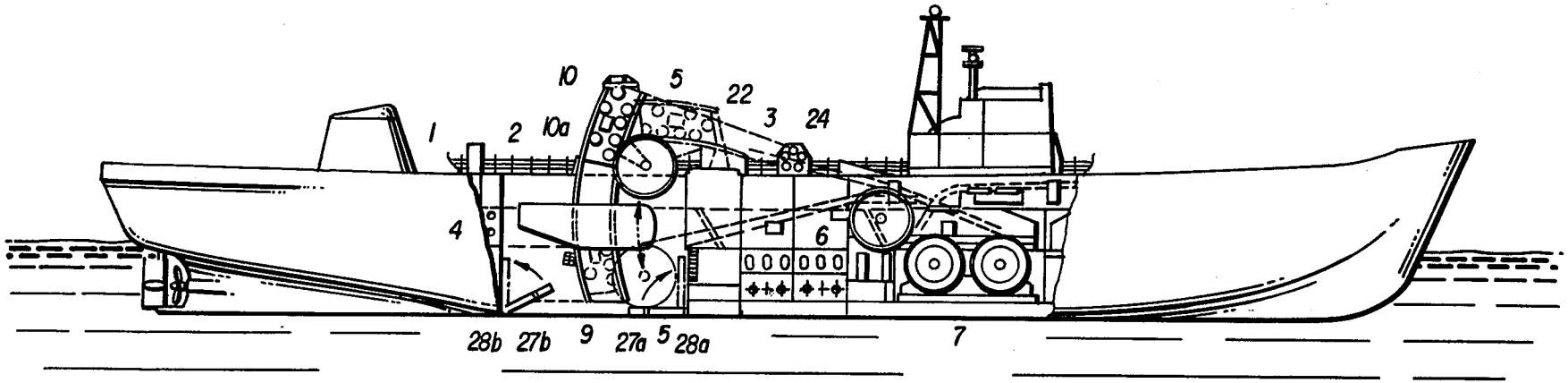
FIG. 1 is a longitudinal section through a ship.

The said ship tows, by means of a cable 3, an immersed body 4 shown in the storage position. The said immersed body carries for example a sonar device.

The traction cable extends through the well 2. It passes over a first mobile pulley 5, lodged in the well, then over a second pulley 6, and over a winch 7. The walls of the well 2 are substantially vertical, save for the front wall which is prolonged by a ramp 8 substantially parallel to the portion 3*a* of the cable 3 connecting the mobile pulley to the fixed pulley when the mobile pulley is in the lowermost position.

During towing, due to the movements imparted to the ship by the swell, relative movements of the immersed body relative to the ship are set up and tend to produce very considerable over-tensions in the cable and to cause wear, due to fatigue, of the portion of the cable passing over the pulleys since that portion is constantly displaced.

In order to remedy these disadvantages, the present invention provides that the first pulley 5 be mounted on a carriage 9 which is movable in slideways 10 fixed to each of the lateral walls of the well. Slideway 10 on the port side of the ship shows in the drawings. The slideway on the starboard side of the ship is symmetrical with the port slideway relative to the median plane of the well, but is not shown in the drawings.

Figure 2:
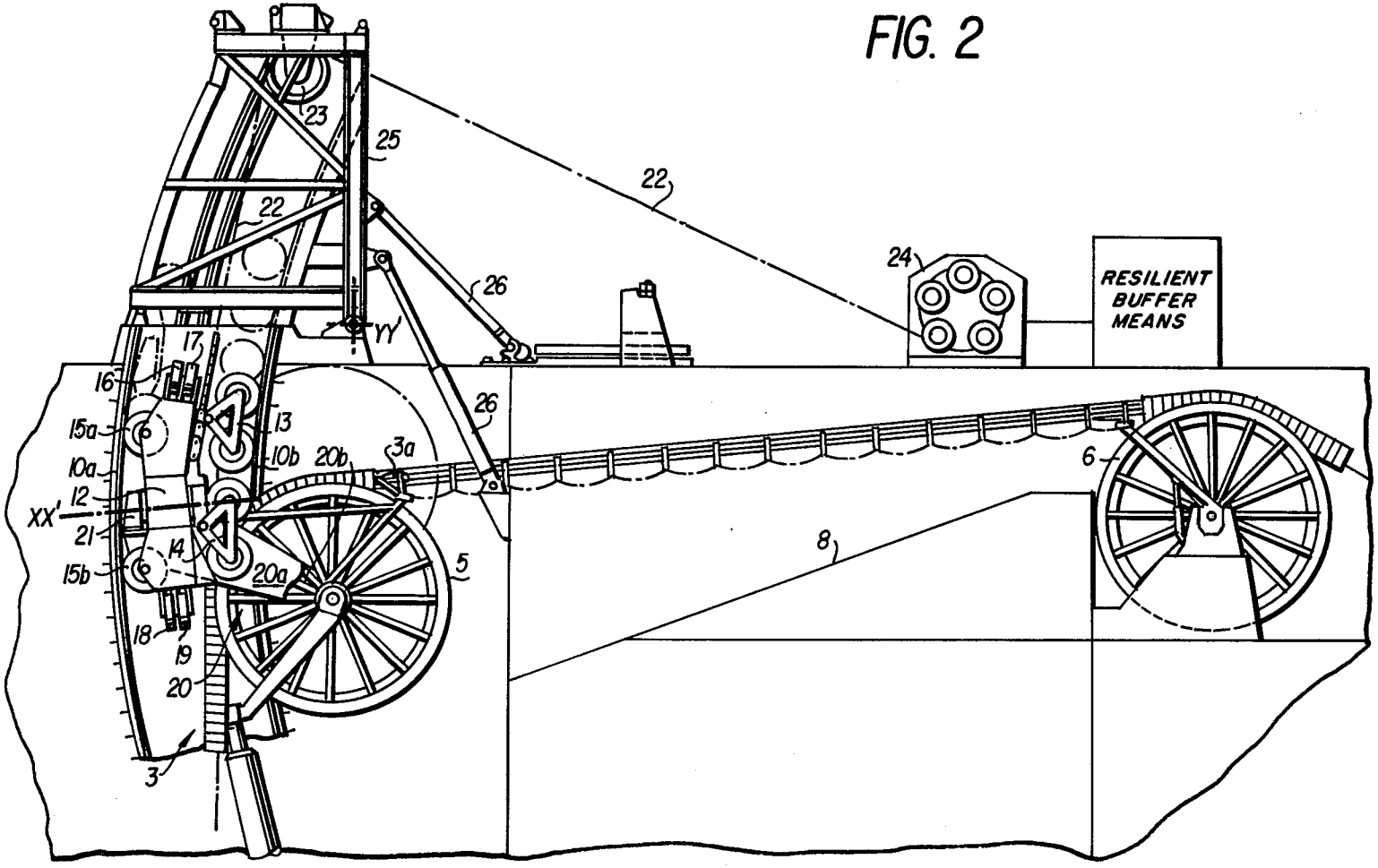
FIG. 2 is a longitudinal section drawn to a larger scale.

FIG. 2 shows, to a larger scale, the carriage and the slideways. Each slideway 10 comprises two rails which are parallel to each other, and may be, for example, two section members of an angle-iron form. The port slideway 10 is comprised of two rails 10*a* and 10*b* and the starboard slieway is of like construction.

The carriage comprises a central beam 12 extending substantially over the entire width of the well. The said beam carries wheels fitted with pneumatic tires which roll on the flanks or sides of the rails 10*a* and 10*b* and the corresponding starboard rails. For example, it carries forwardly two articulated bogies 13 and 14 each having two wheels, and rearwardly two wheels 15*a*, 15*b*. The beam 12 carries, furthermore, at each of its ends, a transverse axle 16, 17 on the upper side and 18, 19 on the lower side, each of the said axles being equipped with two wheels which roll on the lateral walls of the well.

The pulley 5 is connected to the beam 12 by two arms 20 which straddle it and which are mounted on a yoke 21 of fork shape, articulated relative to an axis $x\,x'$. The said axis is parallel to and substantially identical with the axis of the cable run 3*a*. Such articulation enables the pulley 5 to orientate itself so as to remain constantly in the plane determined by the two cable strands 3 passing over the pulley 5 as the ship rolls.

The carriage 9 is suspended from the cables 22 passing over idler pulleys 23 and wound on to winches 24. Idler pulleys 23 are secured to a well-head frame 25, which is of gantry form and surmounts the well. The port and starboard slideways are prolonged upwardly within the well-head frame in such manner that the carriage 9 is able to penetrate entirely into the well-head frame and to pass into upper abutment against the latter. The gantry 25 is articulated about a transverse pivot $y\,y'$ and this pivot is substantially identical with the position occupied by the axis of the pulley 5*a* when the carriage 9 is at the upward abutment position.

Thus, when the carriage is at the upward abutment position, it can be locked with the well-head frame and the assembly may be pivoted about the axis $y\,y'$ to disengage from the upper part of the well, without modifying the tension of the cable 3. Hydraulic jacks 26 permit control of the rocking motion of the well-head frame.

Once the well-head frame rocks, the upper area of the well is disengaged, thereby making it possible to manipulate the immersed body 5 by means of lifting machine, so as to extract it from the well or to lower it into the well.

During hoisting of the immersed body 4 out of the water, the winches 24 function as motor means for lifting the carriage 9 through intermediary of cables 22.

During "towing", the winches 24 may function as oleopneumatic damping means for damping the excess tensions in the tension cables. In order to achieve damping means functioning, it suffices to connect the oil feed circuit of the winches to vessels filled with compressed air and performing the function of resilient buffer means.

The device according to the invention permits a different mode of functioning the object of which it is to render the absolute position of the pulley 5 fixed during towing or haulage, despite the movements of the ship, due to dynamic positioning regulation. The winches 24 then function as motor means subjected to the action of pick-up devices for measuring the vertical accelerations of the ship and the relative displacements of the pulley 5 relative to the ship, in such manner that the absolute position of the pulley remains fixed.

The port slideway 10 and its starboard counterpart have preferably the shape of arcs of a circle centered on the axis of the pulley 6 in such manner that when the pulley 5 is displaced relative to the ship it describes an arc of a circle centered on the axis of the pulley 6, and the length of the intermediary cable strand between the two pulleys remains constant. The result thereof is that the pulley 5 does not rotate on itself, thereby reducing cable fatigue.

According to a further embodiment, the port slideway 10 and its starboard counterpart have the shape of an involute portion of the pulley 6, thereby again suppressing, during towing, the movements of rotation of the pulley 5 on itself.

FIG. 1 shows two rocking gates or doors 27*a* and 27*b*, serving partially to block the lower aperture of the well so as to reduce the drag caused thereby.

The width of the said gates is substantially equal to one third of the distance separating the front and rear walls of the well. The front gate 27*a* is articulated about a transverse pivot 28*a* positioned along the front edge of the lower aperture opening of the well. During haulage, it is in the closed position, as shown in the Figure. The rear gate is articulated about a transverse pivot 28*b* parallel to the rear edge of the lower aperture or opening of the well. During towing, it is in the half-raised position, shown in full line. On the other hand, it is closed when the ship is moving but not towing.

Of course, without exceeding the scope of the invention, various equivalent modifications could be applied by the person skilled in the art to the towing device described hereinabove by way of non-limitative example.

What is claimed is:

1. Device for hauling or towing an immersed body from a ship having a vertical central well defined by two vertical lateral walls and by a rear wall and a front wall extending through said ship said device comprising:

a carriage movable in said well during the towing;

means for mounting said carriage in said well and for compelling it to follow a determined travel path during the towing including slideways fixed on each of said lateral walls;

a first pulley mounted on said carriage; and a traction cable passing over said pulley and adapted to be connected to said immersed body.

2. Device according to claim 1, in which there are two slideways symmetrical relative to the median longitudinal plane of said wall, each slideway comprising two rails which are parallel to each other.

3. Device according to claim 2 further comprising a second pulley for said traction cable which is rotatable about an axis in a fixed position relative to said ship, wherein each of said two slideways comprises two rails which are two arcs of circle centered on said axis of said second pulley so that the length of the cable strand between said first and second pulley remains constant and said first pulley does not rotate on itself when said carriage is moving along said slideways.

4. Device according to claim 3, wherein said first pulley is mounted on said carriage by a yoke of fork shape, which yoke is articulated relative to said carriage about an axis which is parallel and substantially identical with the direction of the traction cable section connecting said first and second pulley so that said first pulley is able to orient itself so as to remain in the plane determined by the cable strand passing over said first pulley despite roll of the ship.

5. Device according to claim 2 further comprising a second pulley for said traction cable which is rotatable about an axis in a fixed position relative to said ship wherein each of said two slideways comprises two rails parallel to each other, each having the form of an involute portion of said second pulley so that during towing the rotative movement of said first pulley are suppressed.

6. Device according to claim 1 comprising two slideways, one on each lateral wall of said well, symmetrical relative to the median longitudinal plane of said well, each slideway comprising two lateral flanks parallel to each other and said carriage comprises a central beam extending substantially over the entire width of the well, which beam carries wheels which roll on said two lateral flanks of each slideway and wheels which roll on the lateral walls of said well.

7. Device according to claim 1, further comprising two doors articulated about two pivots disposed along the front and rear edge of the lower aperture of said well, the width thereof being substantially equal to one third the distance between the said front and rear edge.

8. Device for hauling or towing an immersed body from a ship said device comprising:

a vertical well, extending through said ship, which well is defined by two vertical lateral walls and by a rear wall and a front wall;

a carriage movable in said well during the towing;

a first pulley mounted on said carriage;

a traction cable adapted to be connected to said immersed body, and passing over said first pulley;

and means mounting said carriage in said well for movement in a predetermined path of travel during the towing, which mounting means comprises two slideways symmetrical relative to the median longitudinal plane of said well, each slideway comprising two rails parallel to each other which are fixed on each of said two lateral walls;

a hydraulic winch and a suspension cable, wound on said winch, said carriage being suspended from said cable.

9. Device for hauling or towing an immersed body from a ship having a vertical central well defined by two vertical lateral walls and by a rear wall and a front wall extending through said ship, said device comprising:

a carriage, a first pulley mounted on said carriage;

a traction cable adapted to be connected to said immersed body, which cable passes over said first pulley during said towing;

and means for mounting said carriage in said well for movement along a predetermined travel path during the towing, which means comprises two slideways symmetrical relative to the median longitudinal plane of said well, each slideway comprising two rails parallel to each other which are fixed on each of said two lateral walls;

a hydraulic winch;

a suspension cable wound on said winch from which cable said carriage is suspended; and a well-head frame surmounting said well and supporting idler pulleys for guiding said suspension cable and means for mounting said well-head frame for articulation about a horizontal pivot.

10. Device according to claim 9, wherein said slideways are prolonged upwardly within said well-head frame so that said carriage is able to penetrate entirely into the well-head frame when said carriage comes into upper abutment against said well-head frame and when said carriage is in said upper abutment the position of the axis of said first pulley is substantially identical with said horizontal pivot so that said well-head frame containing said carriage may be pivoted about said horizontal pivot without modifying the tension of said traction cable.

* * * * *